US009310149B2

(12) United States Patent
Masters

(10) Patent No.: US 9,310,149 B2
(45) Date of Patent: Apr. 12, 2016

(54) FIREARM SAFETY AND CHAMBER BLOCK INDICATOR

(71) Applicant: William E. Masters, Greenville, SC (US)

(72) Inventor: William E. Masters, Greenville, SC (US)

( * ) Notice: Subject to any disclaimer, the term of this patent is extended or adjusted under 35 U.S.C. 154(b) by 0 days.

(21) Appl. No.: 14/677,152

(22) Filed: Apr. 2, 2015

(65) Prior Publication Data

US 2016/0076843 A1 Mar. 17, 2016

Related U.S. Application Data

(60) Provisional application No. 61/974,557, filed on Apr. 3, 2014.

(51) Int. Cl.
*F41A 9/53* (2006.01)
*F41A 17/44* (2006.01)

(52) U.S. Cl.
CPC ..... *F41A 17/44* (2013.01)

(58) Field of Classification Search
USPC ..... 42/1.01, 1.05, 70.01, 70.11; 89/1.1
See application file for complete search history.

(56) References Cited

U.S. PATENT DOCUMENTS

| | | | | |
|---|---|---|---|---|
| 3,720,014 | A | 3/1973 | Goodrich | |
| 4,224,753 | A | 9/1980 | Bielman | |
| 4,398,366 | A | 8/1983 | Wernicki | |
| 4,965,952 | A * | 10/1990 | Miller | F41A 17/44 42/1.05 |
| 6,526,684 | B1 | 3/2003 | Hickerson | |
| 6,615,528 | B1 * | 9/2003 | Lindskog | F41A 17/00 42/70.01 |
| 6,796,072 | B2 | 9/2004 | Barber et al. | |
| 6,862,831 | B1 * | 3/2005 | Canaday | F41A 17/44 42/66 |
| 2002/0189148 | A1 | 12/2002 | Hanson | |
| 2007/0079540 | A1 * | 4/2007 | Giebel | F41A 17/063 42/70.11 |
| 2009/0229159 | A1 * | 9/2009 | Roth | F41A 17/44 42/70.01 |
| 2015/0168090 | A1 * | 6/2015 | Bitsack | F41A 17/44 42/70.01 |

* cited by examiner

*Primary Examiner* — J. Woodrow Eldred
(74) *Attorney, Agent, or Firm* — McNair Law Firm, P.A.; Douglas W. Kim

(57) ABSTRACT

This invention is directed to a firearm safety device that has a chamber block for being received in a chamber of a firearm. An internal area is defined in the chamber block and can receive a bullet so that the bullet biases the outer walls outward. A visual indicator is attached to a distal end of the chamber block and is received in the bore of the barrel and extending outward past the muzzle providing a visual indication that the firearm is in a safe condition. In one embodiment, the chamber block can be inserted into the muzzle and the visual indicator extends through the barrel and chamber and out of the ejection port of magazine well. The visual indicator can be modifiable in length to accommodate various lengths of barrels and can be flexible.

18 Claims, 10 Drawing Sheets

FIREARM SAFETY AND CHAMBER BLOCK INDICATOR

FIELD OF THE INVENTION

1) Field of the Invention

Invention is directed to a firearm safety indicator that both renders a firearm safe for handling by preventing a round from being chambered as well as indicating to an observer that the firearm is safe for handling.

2) Background of the Invention

With the growing popularity of firearms, there has been an increased number of firearm sales. The demand is so large that some gun manufacturers were forced to suspend sales in 2012 making statements like the number of orders "exceeds our capacity to rapidly fulfill these orders . . . . " This increased demand naturally results in more customers and potential customers visiting gun stores. This increased demand puts more individuals in proximity with firearms in the retail environment.

In the gun store, firearms are typically displayed in a case or on a wall behind the counter of the retail space. The firearms are stored unloaded. Nevertheless, it is safe gun handling procedures to verify that a firearm is unloaded by clearing the firearm prior to ever handing it to a customer or potential customer. Clearing is desirable in a retail environment where the potential buyer wishes to inspect the firearm and the seller desires to reduce the risk of accidental or intentional discharge of the firearm in the process. Most existing safety devices of a similar nature interfere with the buyer's inspection. Some actually pose a safety risk because they lock the action closed, preventing a person handling the weapon from verifying that the chamber is empty.

However, once the firearm is cleared (chamber checked for empty and magazine removed for semi-automatics), the firearm has no indicator to show it is clear, nor would the clearing process translate to the next individual to handle the firearm.

Several attempts have been made to provide chamber blocking devices that includes United States Patent Application 2002/0189148 directed to a two-part chamber block for a handgun which does not interfere with the inspection, operation, or field stripping of the weapon other than access to the chamber and barrel. However, this attempt does not allow a cartridge to be partially contained in the chamber while preventing the firearm from going into battery but would rather cause the cartridge to potentially eject from the firearm unintentionally. Further, this attempt requires the assembly of two chamber members around a third member prior to being inserted into the firearm.

U.S. Pat. No. 6,526,684 is directed to a safety device that includes a lock sleeve with an expandable end plug which is inserted through the muzzle of a gun barrel. This attempt contains several parts that must interact for operational functionality thereby making the complexity and cost to manufacture prohibitive for the mass use as in a gun store that may have hundreds of firearms in inventory and on display. U.S. Pat. No. 4,398,366 is directed to a gun lock that is also hampered by its inability to be cost effective as a mass use scale and not removable by the retailer or customer or potential customer. The same disadvantage exists for the device shown in U.S. Pat. No. 3,720,014.

U.S. Pat. No. 4,224,753 is a safety device with an inert round that is chambered and a stick that is screwed in to the bullet of the inert round from the muzzle end. This attempt can be removed by the user or potential customer thereby reducing the effectiveness of the safety device for the retail operation.

U.S. Pat. No. 6,796,072 is a safety device that is inserted in the firearm through the breach when the slide is locked back. However, this safety device can be removed by the customer or potential customer while in the retail environment and the protection afforded those in the retail environment is limited.

Therefore, it is an object of the present invention to provide for a firearm safety device that is cost effective to use in mass, indicates that a firearm does not have a cartridge chambered, is easy to remove and require a tool to remove.

SUMMARY OF THE INVENTION

To achieve the objects stated above and other objects of the present invention, a firearm safety device is provided. The invention can include a resilient chamber block for being received in a chamber of a firearm, an internal area defined by inner walls of the chamber block for receiving a bullet of a cartridge so that when a bullet is received into the internal area, outer walls are biased outward, an outer wall included in the chamber block for engaging a case stop of the chamber of the firearm preventing the chamber block from being fully received into a barrel of the firearm; and, a visual indicator attached to a distal end of the chamber block for being received in the bore of the barrel and extending outward past the muzzle providing a visual indication that the firearm is in a safe condition.

A ridge can be defined in the outer wall of the chamber block to engage the case stop. In one embodiment, a plurality of ridges can be defined in the outer wall of the chamber block corresponding to multiple calibers so that one ridge will engage a first case stop of a first caliber firearm and a second ridge will engage a second case stop of a second caliber firearm. A leading edge can be defined in the ridge for engaging with the case stop. A slanted wall can be defined in the outer wall of the chamber block for engaging with the case stop. Flutes can be defined in the outer wall of the chamber stop. A convex wall can be defined in the inner wall of the chamber block to engage the bullet and bias the inner wall outward.

The visual indicator can be flexible so that the visual indicator will not force the chamber block out of the chamber when the visual indicator is pressed into the muzzle.

A detent member can be attached to the visual indicator and a detent internal area defined in the inner wall of the chamber block for receiving the detent member to secure the visual indicator to the chamber block.

An expansion slot can be defined in the chamber block.

A removal tool so that the chamber block cannot be removed from the chamber without using the removal tool can be operatively associated with the chamber block. The chamber block can be generally in the shape of a cartridge with the rim removed and no ejector groove present.

A curved wall defined in the outer wall of the chamber block to assist with the chamber block being received into the chamber.

DETAILED DESCRIPTION OF THE DRAWINGS

The following drawings, incorporated into the specification, will assist those skilled in the art to better understand the present invention:

DESCRIPTION OF THE PREFERRED EMBODIMENT

Figure 1:
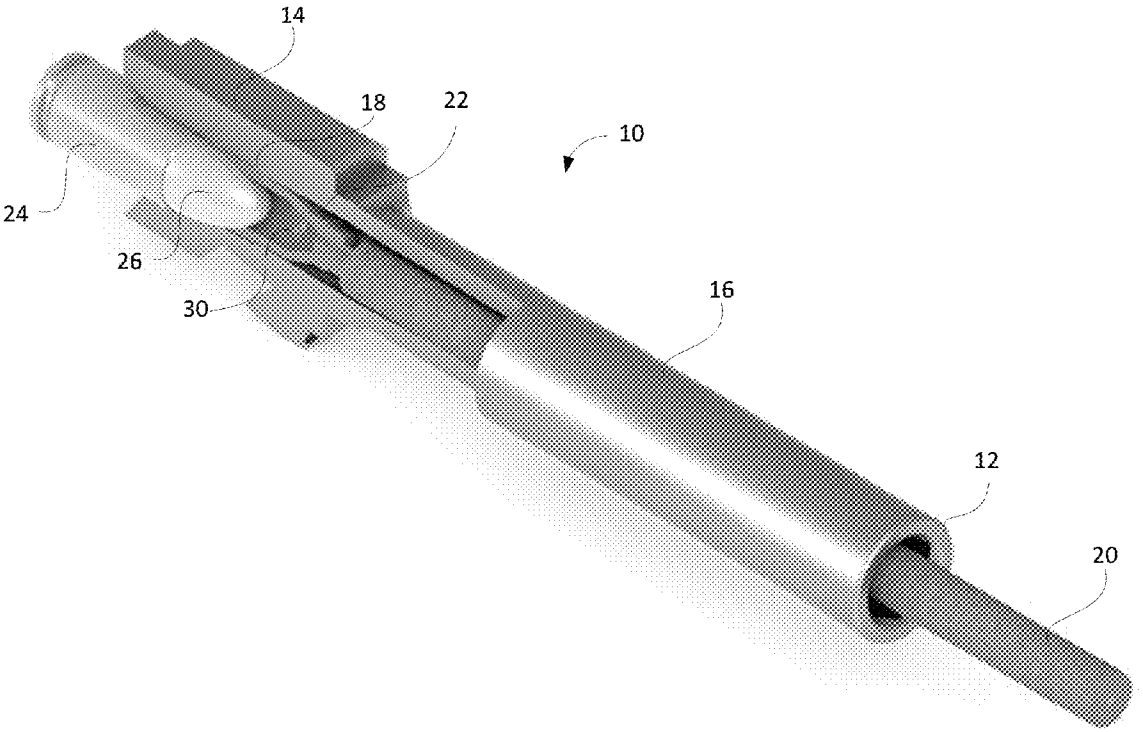
FIG. 1 is a perspective view of aspect of the present invention.

Referring to FIG. 1, barrel 10 including the muzzle 12, barrel 16 and chamber 14 is shown. A case stop 18 is included in the chamber that, in normal operation, has a smaller diameter than the chamber allowing the leading edge of the case stop abut the casing of a cartridge when the cartridge is in the chamber and the firearm is in battery. When the invention is in operation a ridge defined in the chamber block engages the case stop. In one embodiment, a leading edge is included in the ridge for engaging the case stop. The bullet is received into the barrel where the land and groves are located.

The current invention includes a visual indicator 20 that can be received in the barrel from the breach/chamber end and extend past the muzzle so that it is visible outside the barrel thereby indicating a safe condition for the firearm. The visual indicator is connected to the chamber block 22. When the chamber block is inserted into the chamber, the visual indicator extends out of the muzzle. The cartridge 24 is prevented from being chambered as the bullet 26 of the cartridge contacts the internal area 30 of the chamber block and cannot fully be received in the chamber. When the bullet contacts the internal area of the chamber block, the chamber block is pressed against the internal walls of the chamber preventing the cartridge from entering the chamber and preventing the firearm from going into battery. Therefore, the firearm cannot fire. The pressure of the bullet being inserted into the chamber block can force the outer walls of the chamber block against the chamber and case stop insuring that the chamber block cannot be pressed into the chamber allowing the cartridge to be fully received in the chamber. Ridges included on the outer perimeter of the chamber block engage with the case stop preventing the chamber block from traveling into the chamber and barrel too far.

In one embodiment, the visual indicator can be cut to various lengths according to the barrel length. When the visual indicator is constructed of flexible material like or similar to a pipe cleaner, having the visual indicator cut after the invention is installed will insure that sufficient length of the visual indicator will extend from the muzzle without excessive amounts of the visual indicator extending from the muzzle.

Figure 2:
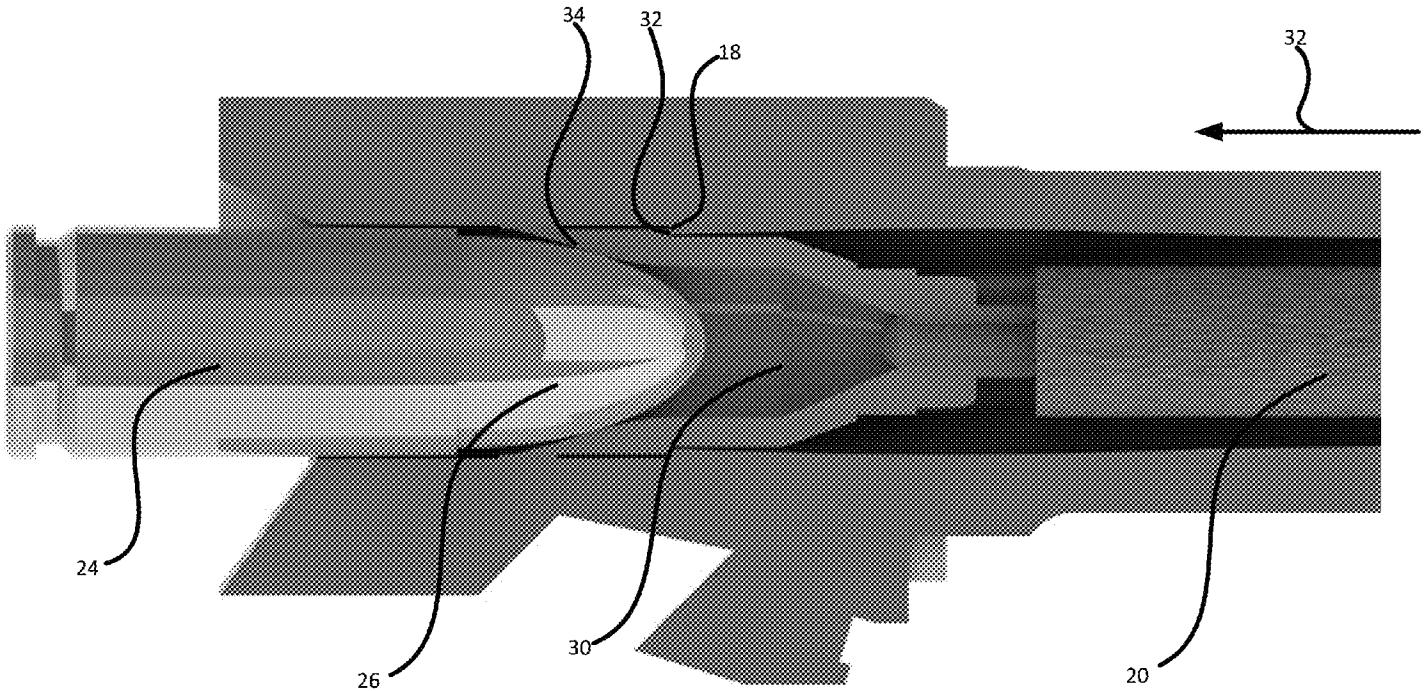
FIG. 2 is a cross section of aspects of the present invention.

Referring to FIG. 2, a cross section of a chamber, barrel and chamber block is shown. The chamber block includes a ridge 32 on the outer wall of the chamber block that can engage the case stop resulting in the chamber block only being inserted into the chamber a certain distance based upon the placement of the ridge on the outer wall of the chamber block. This prevents the cartridge from entering into the chamber sufficiently to allow the cartridge to be fully chambered.

The internal walls of the chamber block can include convex walls 34 that contact the bullet when the bullet is inserted and press the outer walls of the chamber block against the inner walls of the chamber further arresting the movement of the bullet into the chamber. In one embodiment, the chamber block is sufficiently flexible so that the internal area increases as the walls of the chamber block are compressed thereby forcing the chamber block against the inner walls of the chamber arresting travel of the bullet.

The visual indicator 20 can be made from a flexible material so that when it is installed and the visual indicator is extending past the muzzle, the visual indicator cannot be used to force the chamber block rearward. An attempt to push the visual indicator in direction 32 simply causes the visual indicator to be pressed on the barrel without dislodging the chamber block. When the visual indicator is pressed in a direction shown as 32, the visual indicator will collapse into the barrel without causing the chamber block to be pushed out of the chamber. In one embodiment, the visual indicator is a colored pipe cleaner that can include colors associated with warning or danger such as orange, yellow, red and the like.

Figure 3:
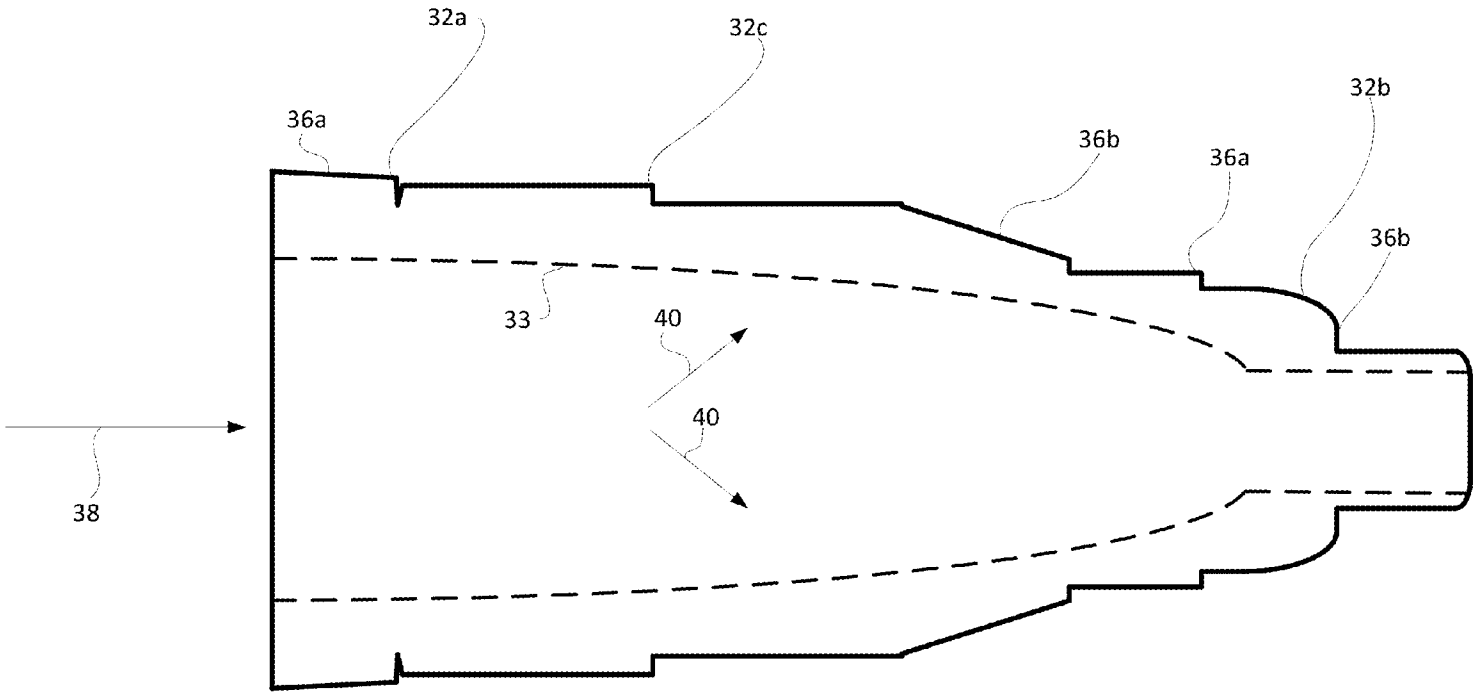
FIG. 3 is a cross section of aspects of the present invention.

Referring to FIG. 3, the chamber block is shown in more detail. The placement of the ridge can be made along the outer wall of the chamber indicator based upon the caliber, chamber dimensions and bore size of the firearm. Available bore and therefore ridge diameters corresponding to calibers can include the following as shown in Table 1:

| Inch Caliber | Typical Bullet Diameter | Common Cartridge |
|---|---|---|
| .20, .204 | 0.204 in | .204 Ruger, 5 mm Remington Rimfire Magnum |
| .22 | 0.220-0.224 in | .22 Long Rifle, .222 Remington, .223 Remington, 5.56 × 45 mm NATO, 5.45 × 39 mm, 5.7 × 28 mm |
| .24 | 0.243 in | .243 Winchester, 6 mm Remington |
| .25 | 0.25 in | .25 ACP, 6.35 × 16 mm SR |
| .26 | 0.264 in | 6.5 × 55 mm, .260 Remington |
| .27 | 0.277 in | .270 Winchester, 6.8 SPC |
| .28 | 0.284 in | .280 Remington, 7 mm Remington Magnum, 7 × 57 mm, 7 mm-08 Remington |
| .30, .308 | 0.308 in | 300 AAC Blackout, .30-06 Springfield, .300 Winchester Magnum, 7.82 Lazzeroni Patriot, .30-30 Winchester, .308 Winchester, 7.62 × 51 mm NATO |
| .303, .31 | 0.31-0.312 in | .303 British, 7.62 × 39, 7.62 × 54R, 7.62 × 25, 7.7 × 58 |
| .323 | 0.323 in | 8 × 57 mm IS, .325 WSM, 8 mm Remington Magnum |
| .338 | 0.338 in | .338 Lapua |
| .357 | 0.355-0.357 in | .38 Special, .380 ACP, .357 Magnum, .357 SIG, .35 Remington, 9 × 19 mm Parabellum, 9 × 18 mm Makarov |
| .40 | 0.400 in | .40 S&W, 10 mm auto |
| .44 | 0.429 in | .44 Magnum |
| .45 | 0.450 in | .45 ACP, .45 GAP, .454 Casull, .45 Long Colt .455 Webley |
| .50 | 0.510 in (12.95 mm) | .50 BMG, .50 Action Express, 12.7 × 108 mm |

In one embodiment, the ridge 32*a* can be placed at the proximal end of the chamber indicator based upon the configuration and dimensions of the chamber. In another embodiment, the ridge 32*b* can be placed near the distal end based upon the chamber configuration of the firearm or between the ends as shown in 32*c*. In one embodiment, one or more slanted walls 36*a* and 36*b* can be defined in the outer wall of the chamber block and contact with the inner wall of the chamber. The slanted walls can engage the case stop as well as prevent the chamber block from being completely received in the barrel. The slanted walls provide for an infinite number diameter sized between the largest perimeter and smallest perimeter of the slanted wall.

In one embodiment, a curved wall 32*b* is included to engage the chamber, case stop or barrel so that the chamber block cannot be fully received in the chamber. The chamber block can include this arcuate surface along the perimeter wall, between one or more ridges, at the distal end and proximal end.

The convex walls 33 of the internal area of the chamber block can begin at the proximal end and extend past the midpoint of the internal area of the chamber block to accommodate differing sizes and shapes of bullets. Multiple diameters can be included in one chamber block so that the chamber block can engage the case stop of several calibers such as a first caliber 32*c*, a second caliber 36 a third caliber 38*a* and a fourth caliber 36*b*.

When the cartridge travels in a direction shown as 38 so that the bullet is received into the internal area of the chamber block, the bullet contacts the inner wall of the chamber block placing a force shown generally in a direction 40 from the cross-section aspect. In one embodiment the ridges, arcuate walls, slanted walls and side walls circumvent the outer wall of the chamber block.

Figure 4A:
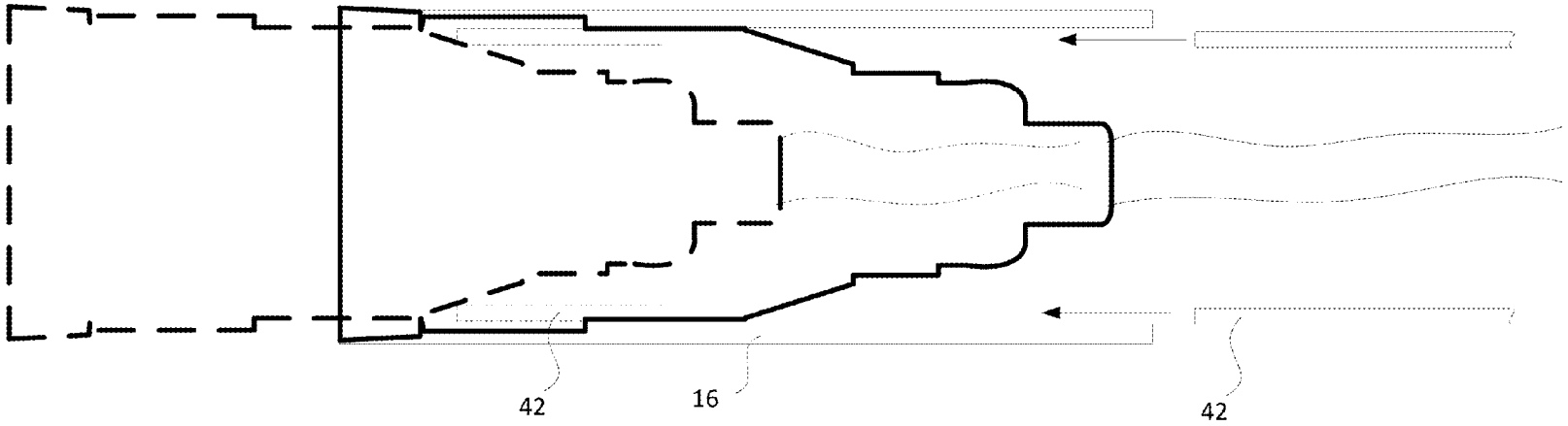
FIG. 4A is a cross section of aspects of the invention.
Figure 4B:
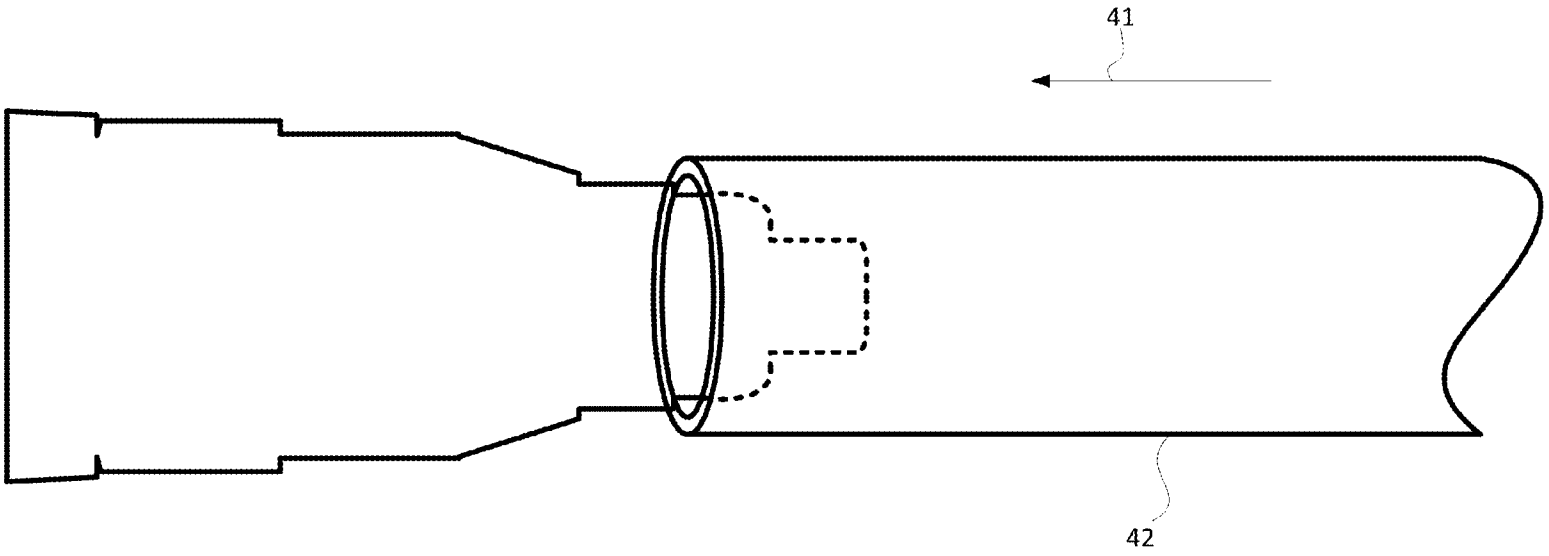
FIG. 4B is a perspective view of a removal tool.

Referring to FIG. 4A, the chamber block cannot be removed from the chamber so that the firearm is maintained in a safe position. A removal tool 42 (FIG. 4B) is used to press the chamber block out of the chamber at the breach end. In one embodiment, the removal tool is a hollow tube that is inserted into the barrel at the muzzle end and is used to force the chamber block out of the chamber in a direction shown as 41. The bore defined in the removal tool can receive the visual indicator to prevent the visual indicator from being crushed by the removal tool. In one embodiment, the removal tool is slightly smaller in diameter than the barrel diameter so that when the removal tool is inserted in to the barrel, it is generally adjacent to the inner wall of the barrel. The removal tool can compress the chamber stop thereby reducing its diameter to facilitate the removal of the chamber block even after the chamber block has been expanded by a bullet.

Figure 5A:
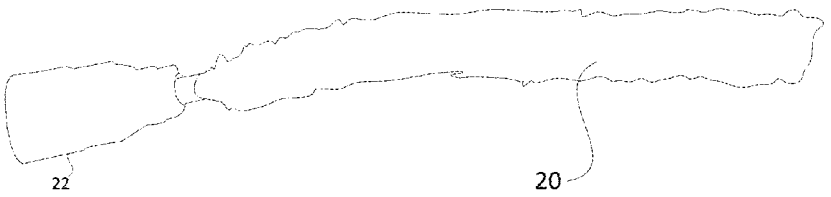
FIGS. 5A through 5C are perspective views of aspects of the invention.
Figure 5B:
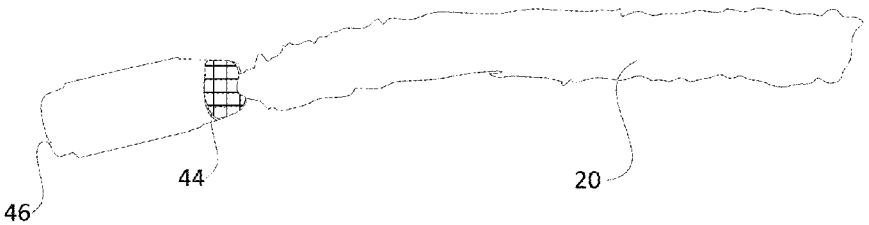
Figure 5C:
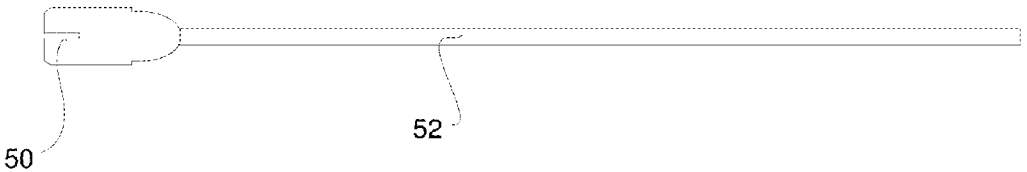

Referring to FIG. 5A, one embodiment of the present invention is shown. In this embodiment, the visual indicator 20 is a flexible material such as a pipe cleaner, semi-ridged string, malleable metal wire and can include coloring to be easily detectable by a viewer. The visual indicator is attached to the chamber block and can compress when pressed in to the barrel when installed. FIG. 5B shows the chamber block 46 in one embodiment where the chamber block is an inert cartridge. The chamber block includes visual marking 44 indicating that the chamber block, while resembling a round, is inert. The retraction rings or rim is typically found on live cartridges to define an ejector groove used by an extractor to remove the cartridge from the chamber. The rim and ejector groove is not present in the chamber block removed so that the extractor of a semi-automatic firearm will not engage the chamber block when the firearm is cycled. FIG. 5C shows a chamber block with expansion slot 50 and a rigid visual indicator 52. In this embodiment, the visual indicator, when pressed toward the chamber, will disengage from the chamber block without dislodging the chamber block from the chamber.

Figure 6A:
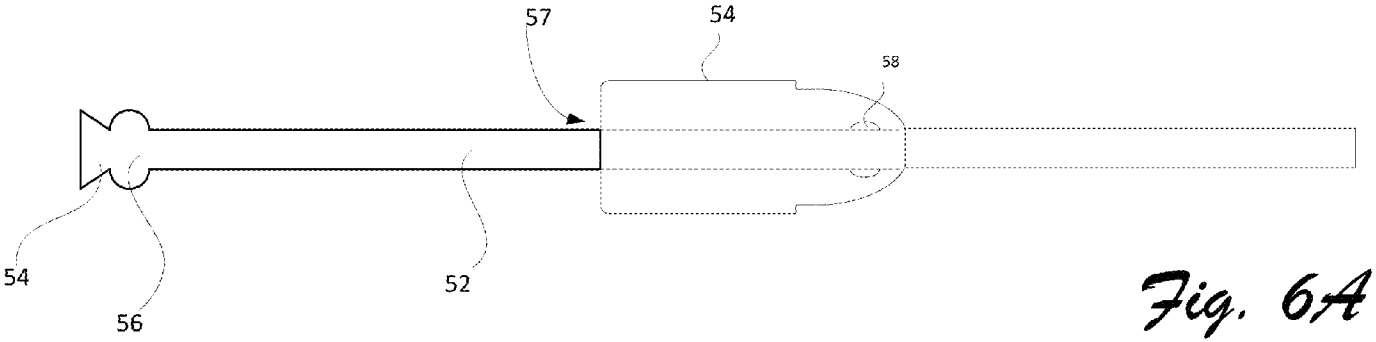
FIGS. 6A and 6B are perspective views of aspects of the invention.
Figure 6B:
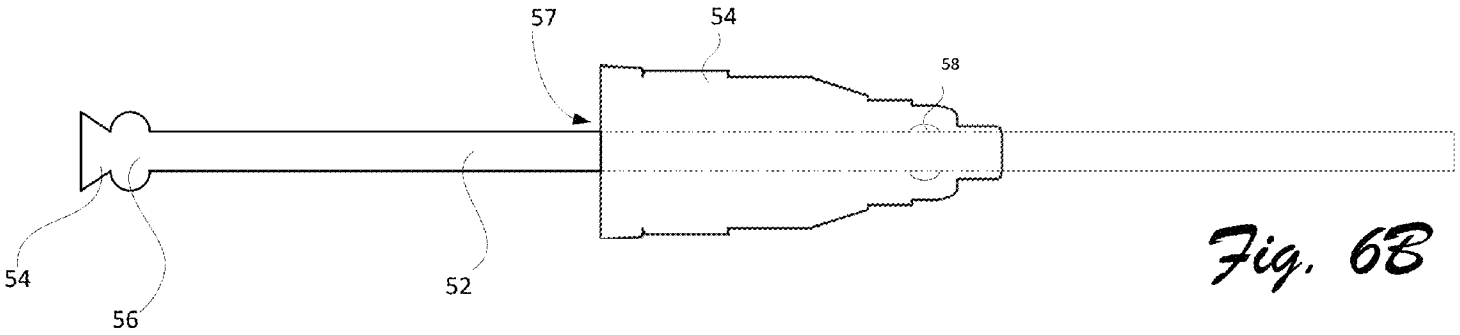

Referring to FIGS. 6A and 6B, in one embodiment of FIG. 5C is shown in further detail. The proximal end of the visual indicator can include an expansion member 54 and detent member 56 attached to the visual indicator. The expansion member is received in the detent internal area 58 of the chamber block and secures the chamber block in the chamber. An opening 57 is defined in the chamber block to receive the visual indicator. The detent member engaged with the detent internal area of the chamber block securing the visual indicator to the chamber member. When the rigid visual indicator 52 is extending from the muzzle and pressed into the muzzle, the detent releases and the indicator disconnects from the chamber block to move toward the chamber, but does not allow the chamber block to be removed from the chamber without the removal tool.

Figure 7A:
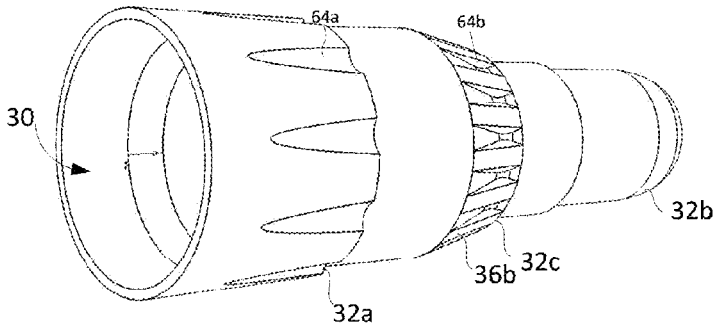
FIGS. 7A through 7B are perspective views of aspects of the invention.
Figure 7B:
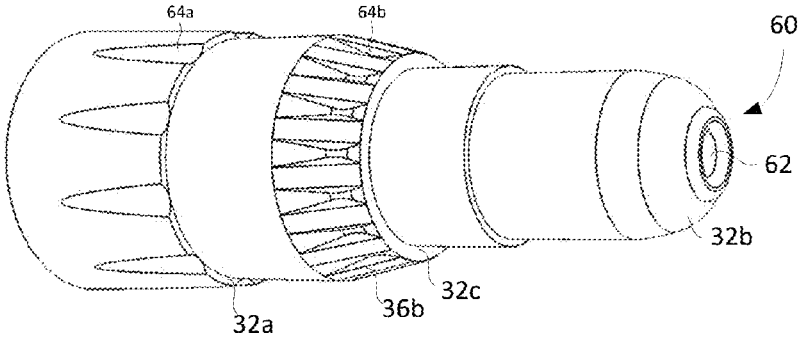
Figure 7C:
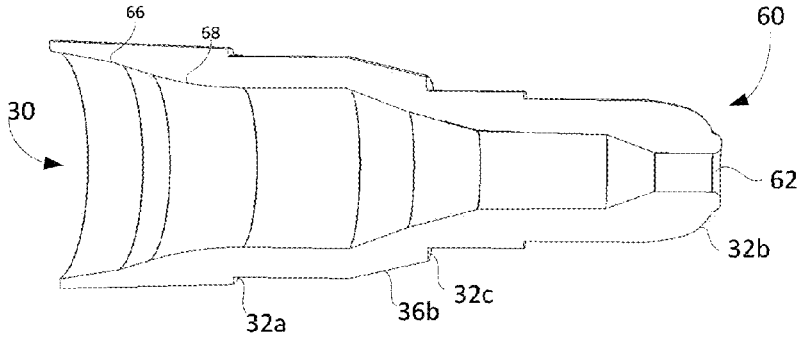
FIG. 7C is a side cutaway view of aspects of the invention.

Referring to FIGS. 7A through 7C, one embodiment of the chamber block is shown. The chamber block 22 can include ridges 32*a* through 32*c*. The slanted wall 36*b* can be defined in the outer wall of the chamber block. Internal area 30 can be defined in the chamber block for receiving a bullet. The distal end can include a rounded area 60 to assist with inserting the chamber block into the chamber of the firearm. A visual indicator opening 62 can be defined in the chamber block for receiving a visual indicator or for attaching a visual indicator to the chamber block. A first set of flutes 64*a* can be included in the outer surface of the chamber block to help prevent the chamber block from sticking in the chamber and for additional strength and reduction in needed materials during manufacturing. A second set of flutes 64*b* can be included in the outer surface of the chamber block to help prevent the chamber block from sticking in the chamber and for additional strength and reduction in needed materials during manufacturing. In one embodiment, the proximal end is tapered so that its diameter decreased moving from the proximal end to the distal end. The internal wall of the proximal end can include a concave portion 66 in one embodiment. In one embodiment, the internal wall can include a convex portion 68. The bore of the chamber block can progressively decrease in size from the proximal end to the distal end.

Figure 8A:
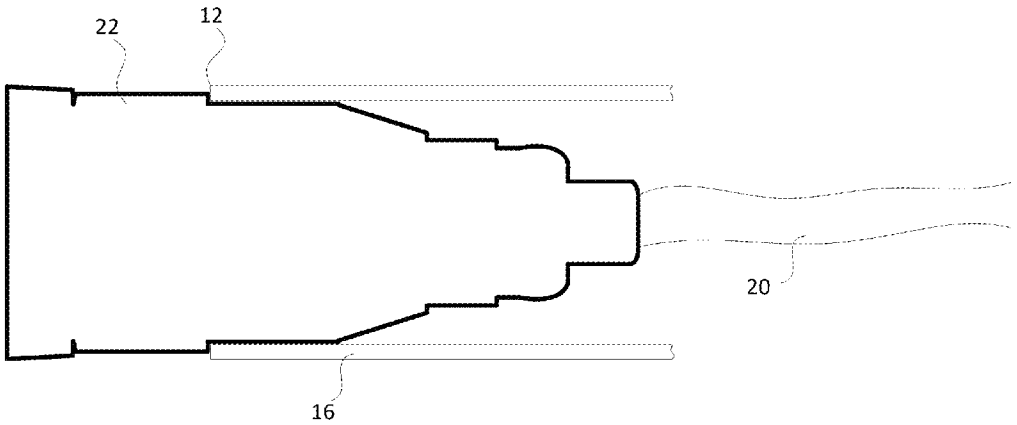
FIGS. 8A and 8B are side cutaway views of aspects of the invention; and, FIG. 9 is a side view is the present invention installed in a semi-automatic pistol.
Figure 8B:
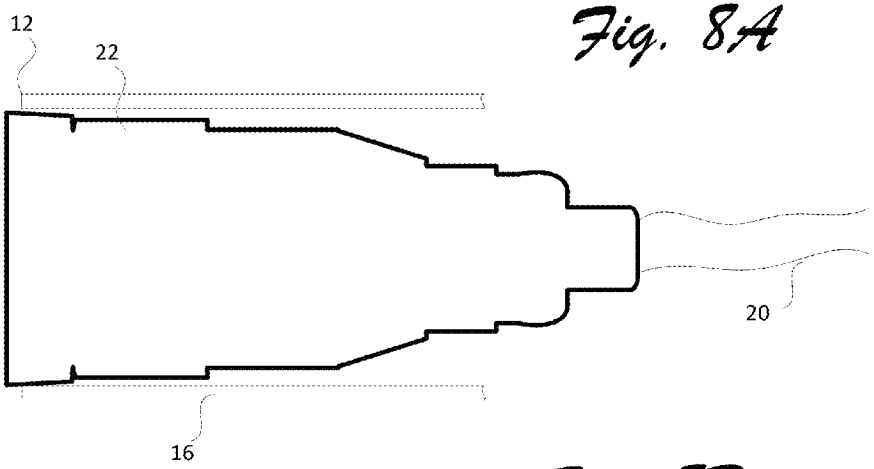

Referring to FIG. 8A, the chamber block can also be received in the muzzle 12 of the firearm and set as a muzzle cap. The multiple varying diameters allow the invention to securely pressure fit in a variety of difference muzzle diameters and calibers. The varying diameters of the chamber block allow the invention to be used with various calibers. Referring to FIG. 8B, the chamber block (muzzle cap in this embodiment), can be substantially received in the muzzle so that the chamber block cannot be removed without the removal tool. The chamber block can be colored such as with orange to assist in visually identifying that the gun is in a safe condition. The chamber block engaged the inner wall of the barrel at the muzzle end, compresses and this compressive force secure the chamber block at eh muzzle end of the barrel. Further, since the visual indicator extends into the chamber, a cartridge cannot be chambered. In one embodiment, less than 50% of the chamber block extends outward from the muzzle. In one embodiment, substantially all of the chamber block is received into the barrel. In one embodiment, 1 to 3 mm of the chamber block extends outward from the muzzle providing sufficient clearance so that the chamber block can be seen. The visual indicator 20 can be flexible and can extend through the barrel, through the chamber and out the ejector port.

Figure 9:
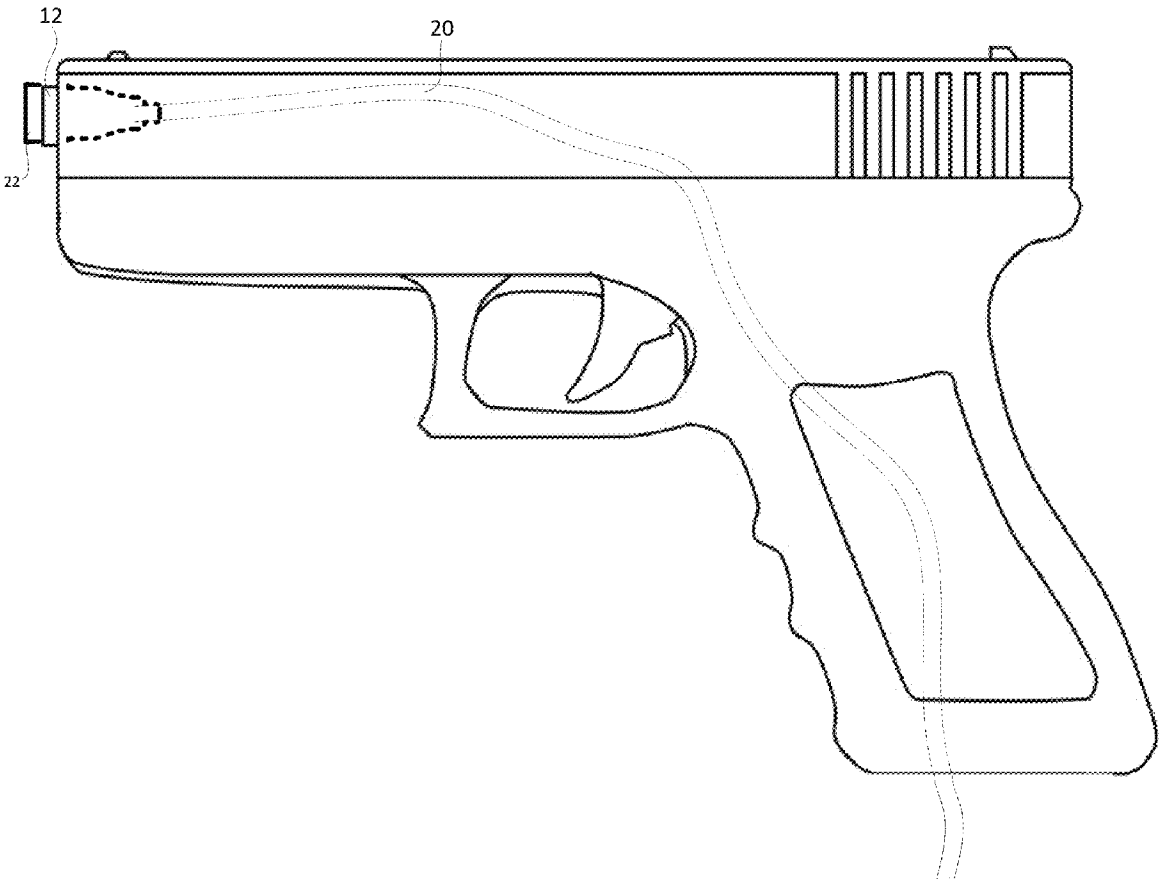

Referring to FIG. 9, in one embodiment, the chamber block (muzzle cap) 22 can protrude out of the muzzle 12 with a portion of the chamber block received in the barrel. The visual indicator 20 can extend through the barrel, through the chamber, down the magazine well and out the bottom of the magazine well as shown in FIG. 9.

The above specification focuses one or more preferred embodiments of the invention. However, as will be recognized by those skilled in the art, the disclosed method and apparatus are applicable to a wide variety of situations in which blocking the chamber and/or barrel of any weapon is desired.

What is claimed is:

1. A firearm safety device comprising:

a resilient chamber block for being received in a chamber of a firearm an internal area defined by inner walls of the chamber block for receiving a bullet of a cartridge so that when a bullet is received into the internal area, outer walls are biased outward, an outer wall included in the chamber block for engaging a case stop of the chamber of the firearm preventing the chamber block from being fully received into a barrel of the firearm; and, a visual indicator attached to a distal end of the chamber block for being received in the bore of the barrel and extending outward past the muzzle providing a visual indication that the firearm is in a safe condition.

2. The apparatus of claim 1 including a ridge defined in the outer wall of the chamber block to engage the case stop.

3. The apparatus of claim 2 including a plurality of ridges defined in the outer wall of the chamber block corresponding to multiple calibers so that one ridge will engage a first case stop of a first caliber firearm and a second ridge will engage a second case stop of a second caliber firearm.

4. The apparatus of claim 1 including a leading edge defined in the ridge for engaging with the case stop.

5. The apparatus of claim 1 including a slanted wall defined in the outer wall of the chamber block for engaging with the case stop.

6. The apparatus of claim 1 including flutes defined in the outer wall of the chamber stop.

7. The apparatus of claim 1 including a convex wall defined in the inner wall of the chamber block to engage the bullet and bias the inner wall outward.

8. The apparatus of claim 1 wherein the visual indicator is flexible so that the visual indicator will not force the chamber block out of the chamber when the visual indicator is pressed into the muzzle.

9. The apparatus of claim 1 including:

a detent member attached to the visual indicator; and, a detent internal area defined in the inner wall of the chamber block for receiving the detent member to secure the visual indicator to the chamber block.

10. The apparatus of claim 1 including an expansion slot defined in the chamber block.

11. The apparatus of claim 1 including a removal tool operatively associated with the chamber block so that the chamber block is removed by inserting the removal tool in the muzzle and into the barrel to remove the chamber block.

12. The apparatus of claim 1 wherein the chamber block is generally in the shape of a cartridge with the rim removed and no ejector groove present.

13. The apparatus of claim 1 including a curved wall defined in the outer wall of the chamber block to assist with the chamber block being received into the chamber.

14. A firearm safety device comprising:

a chamber block for being received in a chamber of a firearm;

an internal area defined in the chamber block for receiving a bullet of a cartridge and preventing the cartridge from fully entering the chamber wherein the inter diameter of the internal area diminishes from the proximal end to the distal end of the chamber block;

a convex wall included in the internal area of the chamber block that when engaged by a bullet biases the walls of the chamber block outward pressing an outer wall of the chamber block against the chamber;

a ridge defined in the outer wall of the chamber block that engages a case stop of the chamber when the chamber block is received into the chamber preventing the chamber block from fully entering a barrel of the firearm;

flutes defined in the outer wall of the chamber block; and, a visual indicator attached to the chamber block extending through the barrel and out a muzzle of the barrel indicating that the firearm is in a safe condition.

15. The apparatus of claim 14 wherein the visual indicator is flexible so that the visual indicator will not force the chamber block out of the chamber when the visual indicator is pressed into the muzzle.

16. The apparatus of claim 14 including an opening in a distal end of the chamber block allowing the visual indicator to extend through the chamber block.

17. The apparatus of claim 16 including:

a detent member attached to the visual indicator wherein the visual indicator is rigid; and, a detent internal area defined in the inner wall of the chamber block for receiving the detent member to secure the visual indicator to the chamber block so that when the visual indicator is pressed into the muzzle, the visual indicator is released from the chamber block and does not remove the chamber block from the chamber.

18. The apparatus of claim 14 including a removal tool operatively associated with the chamber block so that the chamber block is removed by inserting the removal tool in the muzzle and into the barrel to remove the chamber block.

* * * * *